United States Patent [19]

Abendroth et al.

[11] Patent Number: 4,664,032

[45] Date of Patent: May 12, 1987

[54] VERTICALLY ADJUSTABLE GRIPPER SUPPORTS FOR THE GRIPPERS OF REVERSING DRUMS OF PERFECTING PRESSES

[75] Inventors: Paul Abendroth, Offenbach am Main; Roland Holl, Weiterstadt; Josef Mathes, Offenbach am Main; Dietrich Dettinger, Heusenstamm, all of Fed. Rep. of Germany

[73] Assignee: M.A.N.-Roland Druckmaschinen Aktiengesellschaft, Fed. Rep. of Germany

[21] Appl. No.: 838,477

[22] Filed: Mar. 11, 1986

[30] Foreign Application Priority Data

Mar. 12, 1985 [DE] Fed. Rep. of Germany ..... 3508699

[51] Int. Cl.[4] ..... B41F 21/04

[52] U.S. Cl. ..... 101/230; 101/411

[58] Field of Search ..... 101/409, 410, 411, 230, 101/231, 246, 412; 271/82, 204, 206, 186

[56] References Cited

U.S. PATENT DOCUMENTS

| | | | |
|---|---|---|---|
| 1,208,731 | 12/1916 | Blaine | 101/412 |
| 1,271,329 | 7/1918 | Kyle | 101/412 |
| 3,332,345 | 7/1967 | Smyth | 101/409 |

*Primary Examiner*—J. Reed Fisher

*Attorney, Agent, or Firm*—Leydig, Voit & Mayer

[57] ABSTRACT

A vertically adjustable gripper support mechanism for the grippers of turning drums of perfecting presses wherein the sheet is turned by two correlatively cooperating gripper systems disposed on cam-controlled pivot shafts biased by return springs. An adjusting shaft is disposed concentrically within the pivot shaft and is rotatable by an adjusting wheel, the adjusting shaft being formed with axially spaced recesses corresponding to the number of gripper supports and having a plurality of arcuate adjusting surfaces preferably offset at 60° in the peripheral direction to one another to provide a multistep vertical adjustment to the gripper support.

2 Claims, 4 Drawing Figures

VERTICALLY ADJUSTABLE GRIPPER SUPPORTS FOR THE GRIPPERS OF REVERSING DRUMS OF PERFECTING PRESSES

FIELD OF THE INVENTION

The present invention relates generally to the grippers of turning drums of perfecting presses and more particularly concerns a vertically adjustable support for such grippers.

BACKGROUND OF THE INVENTION

The gripper supports for the discrete grippers of cooperating gripper systems for the turning drums of combination first printing and perfecting printing type sheet-fed rotary presses are generally not vertically adjustable. Gripper systems of this kind have been disclosed, for example, in U.S. Pat. Nos. 2,757,610 and 3,385,597. Their range of use is therefore limited since they cannot provide accurate processing of relatively thick kinds of paper stock nor of printing board.

It is also generally known, and it has been disclosed, for example, in U.S. Pat. No. 1,208,731 and DE-PS No. 812,431, that the supports for the grippers of oscillating systems and for gripper systems disposed on a rotating impression cylinder may be adapted for central or individual vertical adjustment. However, these gripper systems have nothing to do with a sheet turning drum for perfecting presses. Theoretically, it is possible for the adjustment described in the patent specifications mentioned and using a drawing wedge (U.S. Pat. No. 1,208,731) or an eccentric bushing (DE-PS No. 812,431) to be transferred to turning drums. However, because of the constructional and operational features of the two correlatively cooperating gripper systems of a turning drum, more particularly because of the considerations associated with substantial printing widths and the accompanying severe torsional deformation of the pivot shaft and very reduced free spaces for the gripper systems, which oscillate towards and away from one another, it has so far proved impossible for the known vertical adjustment facilities to be incorporated in and operate satisfactorily in the gripper systems of a turning drum.

OBJECTS AND SUMMARY OF THE INVENTION

It is the primary aim of the present invention to provide vertically adjustable gripper supports for the grippers of turning drums of perfecting presses so that such drums can be used for all kinds of paper stock and printing board.

Accordingly such a vertically adjustable gripper support mechanism is provided wherein the sheet is turned by two correlatively cooperating gripper systems disposed on cam-controlled pivot shafts biased by return springs, characterized in that an adjusting shaft is disposed concentrically within the pivot shaft and is rotatable by an external adjusting wheel. The adjusting shaft is formed with axially spaced recesses corresponding to the number of gripper supports, the recesses being formed with a plurality of arcuate adjusting surfaces offset at about 60° with respect to one another in the peripheral direction and having respective curvature radii so as to provide three step vertical adjustment to the gripper support, the gripper supports being slidably mounted in radial journal means and being resiliently biased by spring means directly on the adjusting surfaces.

More particularly, the advantages provided by the invention are that the discrete gripper supports, which register with one another in an enclosed construction, can be vertically adjusted without backlash, yet no additional space is required for the vertical adjustment. Furthermore, substantial torsional deformations of the pivot shaft which would impair adjustment accuracy, are avoided, particularly in the case of substantial printing widths. It is precisely these effects which are important in connection with the vertical adjustment of the supports of grippers of the turning drums of perfecting presses of substantial printing width where the pivot shafts are driven by cam-operated levers which introduce very substantial and asymmetrical torsional forces when driven from one side only.

These and other features and advantages of the invention will be more readily apparent upon reading the following description of the preferred embodiments of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
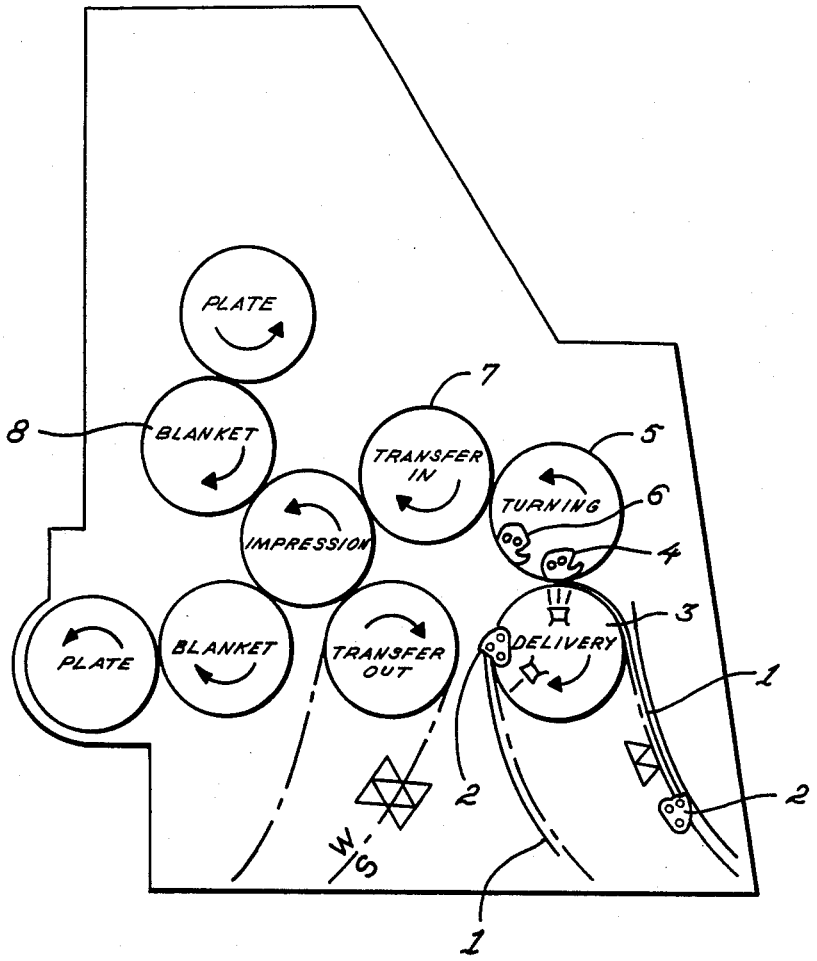
FIG. 1 shows, in diagrammatic form, the movement of a sheet during perfecting printing in a sheet-fed rotary press.

Turning now to the drawings, FIG. 1 shows, in diagrammatic form, the path of a sheet 1 during perfecting printing through a sheet-fed rotary press in which two double printing units 8 are disposed one after another. For perfecting printing, a gripper trolley 2 conveys a sheet 1, already printed on one side, beyond the surface of a supply drum or suction drum 3 until the trailing end of the sheet is in position for turning. In this position, the first gripper system 4 of the turning drum 5 engages the sheet trailing end and the sheet is turned and conveyed further with the aid of a second gripper system 6 on the drum 5. The gripper trolley 2 continues to guide the sheet 1 until a gripper-opening cam, located downstream in the departure path of the sheet, releases the forward end of the sheet. It will be understood that the previous forward end of the sheet is now the trailing end of the sheet.

During further conveyance of the sheet 1 the turning drum 5 delivers the sheet to a transfer drum 7. The transfer drum 7 then conveys the sheet to the impression cylinder of the second double printing unit 8 for second printing.

Upon a changeover to first side printing, the sheet 1 passes directly from the drum 3, by way of the drum 5, now operative as an intermediate drum, and then by way of the transfer drum 7, to the printing unit 8. In this case there is no turning of the sheets by the turning drum 5, since only one printing system, namely the first-printing system, is operative.

Figure 2:
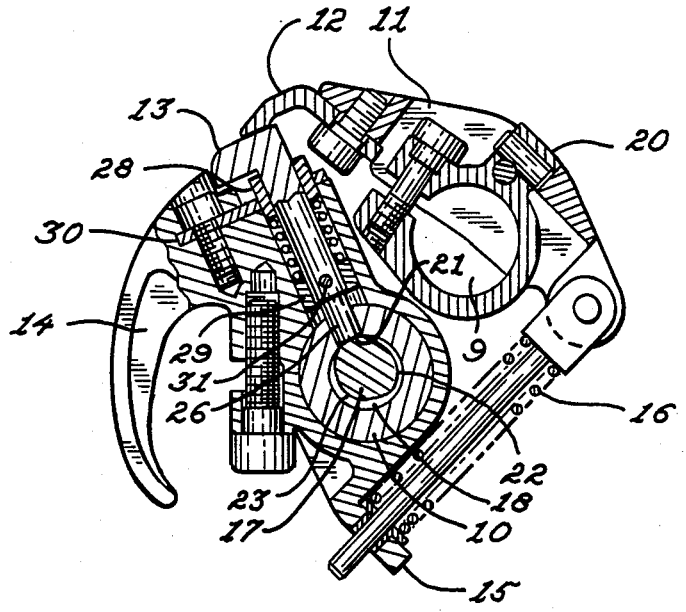
FIG. 2 is an enlarged, fragmentary cross-section through the turning drum gripper system according to the present invention.
Figure 3:
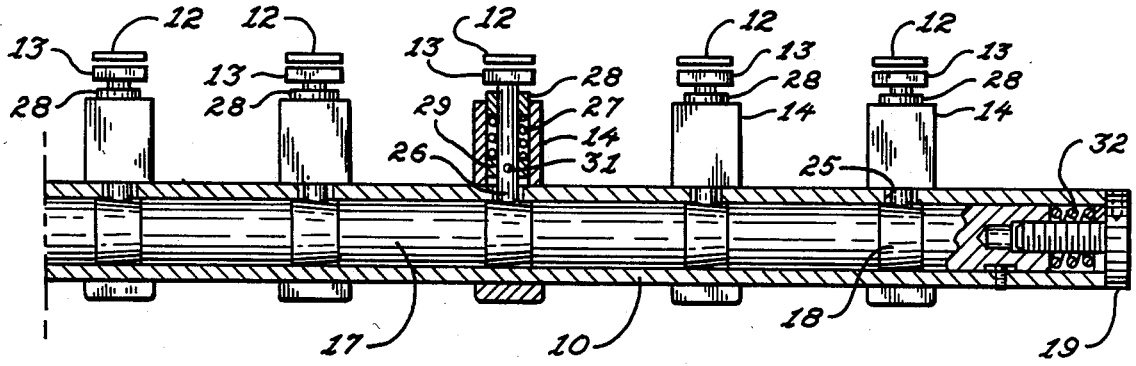
FIG. 3 is a longitudinal section through part of the system shown in FIG. 2 according to the invention.

Referring to FIGS. 2 and 3, turning-drum grippers 11 are mounted in conventional manner on a gripper shaft 9 actuatable by a gripper-actuating mechanism (not shown). It will also be understood that the gripper shaft 9 is mounted, in gripper shaft brackets (not shown), so as to be rotatable relatively to a pivot shaft 10. The grippers 11 have replaceable tips 12 with which vertically adjustable gripper supports 13 are associated.

In accordance with the present invention, there are secured to the pivot shaft 10, bracket means 14 which serve to retain the support 13 and which have a projecting arm 15 carrying a return spring 16 opposing the rotation of a clamping member 20 mounting the gripper 11 on the shaft 9. The return spring 16 presses the gripper tips 12 into engagement with the gripper supports 13.

A central adjusting shaft 17 is incorporated in the pivot shaft 10. The shaft 17 is formed along its length for each gripper 11 with a recess 18 arranged with arcuate surfaces at 60° increments in the peripheral direction for at least three vertical adjustments of the supports 13. In the preferred embodiment, these adjustments are on the order of about 0.3 mm, 0.6 mm and 0.9 mm, respectively, so that the drum 5 can be changed over rapidly and accurately to suit different thicknesses of paper stock or to suit printing board. The adjustment is effectuated by moving an outboard central wheel 19 against the bias of an axial indexing spring 32 to turn the shaft 17 which is disposed in the shaft 10.

Figure 4:
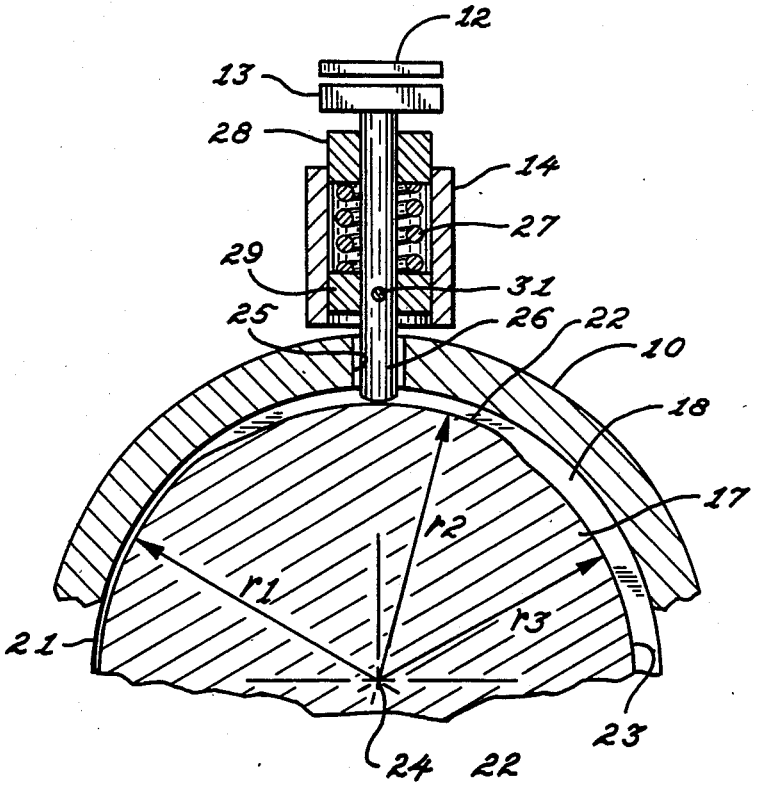
FIG. 4 is a still further enlarged, fragmentary cross section of an adjusting cam within the adjusting shaft of the gripper system according to the present invention.

FIG. 4 shows more detailed particulars of a three-stage adjusting cam. The recesses 18 in the shaft 17 remain on the arcuate adjusting surfaces 21–23 despite substantial torsional deformation of the pivot shaft 10 since the supports 13 can rotate only centrally on the surfaces 21–23, whose curvature radii r1, r2, r3 have their origin on the drive axis 24 of the pivot shaft 10. To this end, journals 26 associated with the gripper support 13 are guided for vertical adjustment in radial bores or journals 25 in the pivot shaft 10 and the supports 13 are pressed without backlash on to the surfaces 21–23 by resilient members 27–29 and 31.

In operation, the exact adjusted height of the supports 13 remains operative despite relatively large printing widths and correspondingly substantial torsional deformation of the pivot shaft 10, so that closures of the grippers 11 remain identical. Combining the pivot shaft 10 with the adjusting shaft 17 makes it unnecessary to provide additional space for the adjusting facility according to the invention. The resilient element 27–29 comprises a spring 27 which extends around a rotationally symmetrical part of the gripper support 13 and is disposed between, on the one hand, a moving bushing 29 and, on the other hand, a bushing 28 fixedly disposed in the upper support retaining means 14 on a plate 30 (FIG. 2), the bushing 29 being adapted to slide together with the support 13 in the bracket means 14 and in the radial bores 25 of the pivot shaft 10. Each support 13 is readily replaceable, the plate 30 first being removed. The gripper tips 12 are also readily and individually replaceable. Moreover, the enclosed construction of the vertically adjustable gripper system of the turning drum 5 prevents soiling in operation and facilities servicing.

We claim as our invention:

1. A vertically adjustable gripper support mechanism for the grippers of a turning drum of a perfecting press wherein the sheet is turned by two correlatively cooperating gripper systems disposed on cam-controlled pivot shafts biased by return springs, there being associated with each turning-drum gripper a gripper support with retention means which are secured to the respective pivot shaft and have a trailing arm on which one end of the return spring bears, the other end of the return spring being operative on a trailing arm of the turning-drum gripper, characterized in that an adjusting shaft is disposed concentrically within the respection pivot shaft and is rotatable by an external adjusting wheel, the adjusting shaft being formed with axially spaced recesses corresponding to the number of gripper supports, the recesses being formed with a plurality of arcuate adjusting surfaces offset at about 60° with respect to one another in the peripheral direction and having respective curvature radii r1, r2 and r3 from the origin of the drive axis of the respective pivot shaft to provide three step vertical adjustment to the gripper supports, the gripper supports being slidably mounted in radial journal means and being resiliently biased by spring means directly on the adjusting surfaces.

2. A gripper support according to claim 1, characterized in that each said gripper has a gripper tip engagable with a respective gripper support, and said gripper tips and gripper supports are replaceable individually.

* * * * *